US009611724B2

(12) United States Patent
Hunter et al.

(10) Patent No.: US 9,611,724 B2
(45) Date of Patent: Apr. 4, 2017

(54) DAMPING PRESSURE PULSES IN A WELL SYSTEM

(71) Applicant: HALLIBURTON ENERGY SERVICES, INC., Houston, TX (US)

(72) Inventors: Timothy Holiman Hunter, Duncan, OK (US); Travis Wayne Cavender, Angleton, TX (US)

(73) Assignee: Halliburton Energy Services Inc., Houston, TX (US)

( * ) Notice: Subject to any disclaimer, the term of this patent is extended or adjusted under 35 U.S.C. 154(b) by 0 days.

(21) Appl. No.: 14/909,723

(22) PCT Filed: Aug. 23, 2013

(86) PCT No.: PCT/US2013/056484
§ 371 (c)(1),
(2) Date: Feb. 2, 2016

(87) PCT Pub. No.: WO2015/026372
PCT Pub. Date: Feb. 26, 2015

(65) Prior Publication Data

US 2016/0186529 A1 Jun. 30, 2016

(51) Int. Cl.

| | |
|---|---|
| ***E21B 41/00*** | (2006.01) |
| ***E21B 43/26*** | (2006.01) |
| ***E21B 28/00*** | (2006.01) |
| ***E21B 43/00*** | (2006.01) |

(52) U.S. Cl.
CPC ..... *E21B 41/00* (2013.01); *E21B 28/00* (2013.01); *E21B 43/003* (2013.01); *E21B 43/26* (2013.01)

(58) Field of Classification Search
CPC ..... E21B 41/00; E21B 43/26; E21B 28/00; E21B 43/003; E21B 47/091; E21B 47/18; E21B 47/182; E21B 47/185; E21B 47/187
See application file for complete search history.

(56) References Cited

U.S. PATENT DOCUMENTS 2,437,456 A * 3/1948 Bodine, Jr. ..... E21B 37/08 116/137 A
3,709,294 A * 1/1973 Kilgore ..... E21B 43/1195 166/242.1
4,858,718 A * 8/1989 Chelminski ..... E21B 47/011 181/106

(Continued)

OTHER PUBLICATIONS

Dictionary definitions of "foam" and "colloid", accessed Sep. 23, 2016 via thefreedictionary.com.*

(Continued)

*Primary Examiner* — Blake Michener
(74) *Attorney, Agent, or Firm* — John W. Wusenberg; Parker Justiss, P.C.

(57) ABSTRACT

A damper is provided for a well system. The well system utilizes a pressure pulse generator in the wellbore to generate a pressure pulse through fluid, such as treatment fluid, in the wellbore. The damper is received in the wellbore to damp transmission of the pressure pulse through the fluid while also allowing fluid to flow through the wellbore between a terranean surface and a location adjacent the pressure pulse generator. In certain instances, the damper allows flow of fluid past the damper while damping transmission of the pressure pulse through the fluid.

18 Claims, 5 Drawing Sheets

(56) References Cited

U.S. PATENT DOCUMENTS

| | | | | |
|---|---|---|---|---|
| 5,984,578 | A * | 11/1999 | Hanesian | B09C 1/00 166/177.2 |
| 6,456,566 | B1 * | 9/2002 | Aronstam | G01V 1/40 181/105 |
| 7,145,786 | B2 | 12/2006 | Vinciarelli | |
| 2004/0168805 | A1 | 9/2004 | Fripp et al. | |
| 2009/0166045 | A1 | 7/2009 | Wetzel et al. | |
| 2009/0223714 | A1 | 9/2009 | Hill et al. | |
| 2010/0044032 | A1 * | 2/2010 | Kabishcher | E21B 28/00 166/249 |
| 2010/0101803 | A1 | 4/2010 | Clayton et al. | |
| 2011/0127031 | A1 * | 6/2011 | Zolezzi Garreton | E21B 28/00 166/249 |
| 2012/0132416 | A1 * | 5/2012 | Zolezzi-Garreton | E21B 43/003 166/249 |
| 2013/0037259 | A1 | 2/2013 | Cavender et al. | |
| 2016/0230515 | A1 * | 8/2016 | Hunter | E21B 49/00 |

OTHER PUBLICATIONS

Schlumberger Oilfield Glossary entry for "slug", accessed Jan. 9, 2017 via www.glossary.oilfield.slb.com.*

Authorized Officer Chang Ho Lee, PCT International Search Report and Written Opinion of the International Searching Authority, PCT/US2013/056484, May 20, 2014, 13 pages.

PCT International Preliminary Report on Patentability for Application No. PCT/US2013/056484, dated Feb. 23, 2016.

* cited by examiner

DAMPING PRESSURE PULSES IN A WELL SYSTEM

This application is a U.S. National Phase Application under 35 U.S.C. §371 and claims the benefit of priority to PCT Application Serial No. PCT/US2013/056484, filed on Aug. 23, 2013 and entitled "Damping Pressure Pulses in a Well System", the contents of which are hereby incorporated by reference.

BACKGROUND

The present disclosure relates to damping pressure pulses in a well system.

Treatment fluids can be injected into a subterranean formation for a variety of purposes, including to facilitate production of fluid resources from the formation. For example, in a hydraulic fracturing treatment, fracture treatment fluids are pumped into the formation through a wellbore at high pressure and high rate to cause the formation around the wellbore to fracture. The resulting fracture efficiently conducts fluids from a large area of the formation back to the wellbore. In an acid treatment, for example, an acid treatment fluid can be pumped through a wellbore into the formation, in connection with or apart from a fracturing treatment, to increase or restore the permeability of rock matrix. In a heated fluid treatment, heated treatment fluids, such as steam, can be pumped through a wellbore into the formation to reduce the viscosity of fluid resources in the formation, so that the resources can more freely flow into the wellbore and to the surface. In sweep injection treatment, sweep treatment fluids may be injected into one or more injection wellbores to drive fluid resources in the formation towards other wellbores. Other examples of treatments and treatment fluids exist.

In addition to or apart from use of treatment fluids, energy can be emitted in the subterranean zone via a downhole pressure pulse generator for a variety of purposes, including for fracturing or for facilitating fracturing the formation, and for stimulating the rock matrix of the formation to facilitate communication of treatment or other fluids through the formation. Other examples exist, and often the pressure pulse is applied in connection with another well treatment. The propagating energy is often quite strong, for example, creating pulses orders of magnitude of the pressure in the well system. Containing this magnitude of energy waves prevents damage of the downhole and surface well system and equipment and helps to concentrate the energy waves to the subterranean formation.

DETAILED DESCRIPTION

Figure 1:
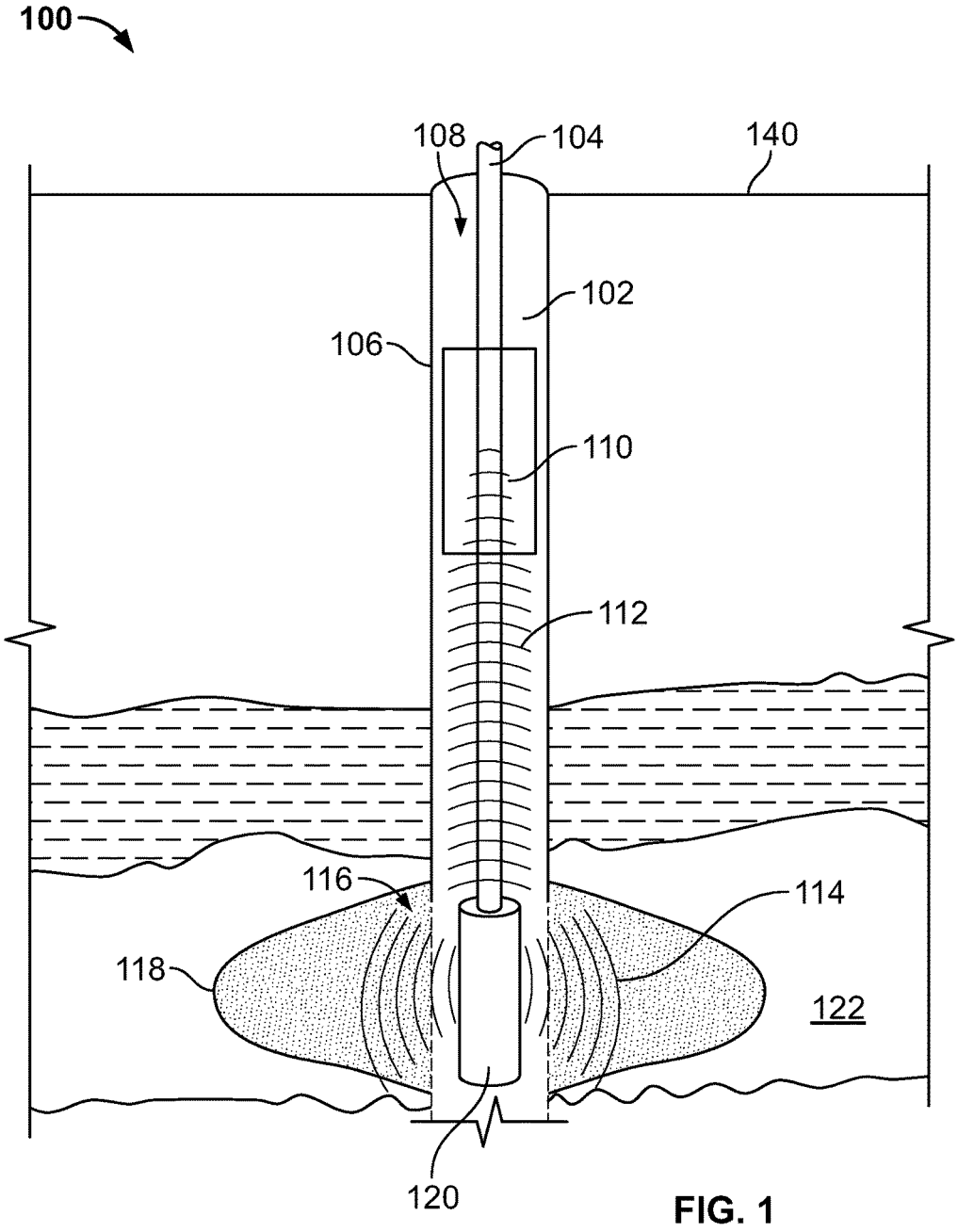
FIG. 1 is a schematic, side cross-sectional view of an example well system with a damper system.

FIG. 1 is a diagram illustrating an example well system 100. The example well system 100 includes a wellbore 102 defined in a subterranean formation below the terranean surface 140. The wellbore 102 is cased by a casing 106, which may be cemented in the wellbore 102. In some cases, all or a portion of the wellbore may be an open hole wellbore, without the casing 106. A wellbore 102 can include any combination of horizontal, vertical, curved, and/or slanted sections.

The well system 100 includes a working string 104 configured to reside in the wellbore 102. The working string 104 terminates above the surface 140. The working string 104 includes a tubular conduit of jointed and/or coiled tubing configured to transfer materials into and/or out of the wellbore 102. For example, the working string 104 can communicate fluid 108 into or through a portion of the wellbore 102. In the present example, the fluid 108 is a treatment fluid for a fracturing treatment, an acidizing treatment, a water flood treatment, a steam injection treatment (including cyclical steam injection treatments, i.e., huff and puff, and steam assisted gravity drainage treatments, i.e., SAGD), or another treatment. However, in other instances, the fluid 108 can be reservoir fluids, drilling mud, completion fluid, or another fluid in the wellbore. The working string 104 can be in fluid communication with a treatment fluid supply source. Example fluid supply sources include a steam generator, a surface compressor, a boiler, and/or a pressurized tank. In other instances, the well system 100 can be provided without the working string 104. For example, well tools can be communicated in an out of the wellbore 102 via a wire (wireline, slickline, e-line, etc.).

The casing can include perforations 116 in a subterranean region or zone, and the treatment fluid 108 can flow into a treatment zone 118 through the perforations 116. In instances where the wellbore 102 is left open in an "open hole configuration" coinciding with the treatment zone 118, the treatment fluid 108 can flow through the open hole wall of the wellbore 102. Additionally, resources (e.g., oil, gas, and/or others) and other materials (e.g., sand, water, and/or others) may be extracted from the zone of interest 118. The casing 106 or the working string 104 can include a number of other systems and tools not illustrated in the figures.

The well system includes one or more downhole type pressure pulse generators 120. A pressure pulse generator 120, also known as an acoustic pulse generator, is a device configured to create propagating energy waves via a pressure pulse. The pressure pulse generator 120 creates one or more pressure pulses of specified characteristics (e.g., frequency, magnitude, duration and/or other characteristics). The characteristics of the pressure pulses can be distinct from the ambient pressure waves in the wellbore environment, such as ambient pressure caused by operating equipment in the wellbore (of the type not intended for producing pressure/acoustic pulses). For example, the pressure pulse generator 120 can create pressure pulses with many times greater magnitude than any ambient pressure waves in the wellbore 102. The pressure pulse generator 120 can generate the pressure pulses into the fluids in the wellbore, including the treatment fluid 108 or other fluids or combinations of fluids. In certain instances, the pressure pulse is a reservoir treatment pressure pulse with specified characteristics for treating the treatment zone 118 or for augmenting another treatment of the treatment zone 118. In certain instances, the pressure pulse generator 120 creates energy waves with a specified frequency or frequencies of 1-20 Hz, 1-40 Hz or other. The pressure pulse generator 120 can be located at any position along the length of the wellbore, but in most instances it will be located in, adjacent or near the treatment zone 118. The pressure pulse generator 120 can be affixed to the string 104 or the casing 106, or supported on wire. The pressure pulse generator 120 can generate energy waves via several possible manners, including acoustic, via combustion or pyrotechnic manners. In certain instances, the pressure pulse generator 120 can create a pressure pulse of approximately ten times greater than a pressure of the treatment fluid 108.

The pressure pulse generator 120 is designed to create lateral energy waves 114, i.e., to emanate generally radially from the wellbore, to excite the matrix in the treatment zone 118. The lateral energy waves 114 generated by the pressure pulse can be useful for several purposes. For example, a water flood fluid can be pumped into the wellbore 102 and the pressure pulse can excite the matrix to improve water flow in the treatment zone 118, such as by improving the uniform distribution of the water through the zone 118. As another example, the matrix can be excited by a pressure pulse while an acid is pumped into the wellbore 102, which can improve acidization of the matrix. As another example, the pressure pulse generator 120 can activate while a fracturing fluid is present in and/or being pumped into the wellbore 102. The pressure pulse can create further fracturing of the treatment zone to improve permeability and flow.

In a typical implementation, treatment fluid 108 is continuously pumped into the wellbore 102, for example via the working string 104 and/or the annulus between the working string 104 and wellbore 102 wall, while the pressure pulse generator 120 is activated. A portion of the energy waves created by the pressure pulse generator 120 tend to propagate axially through the treatment fluid 108 towards the surface 140 and toward the bottom of the wellbore 102. In some instances, these energy waves 112 can damage the string 104, the casing 106, associated equipment or other components inside the wellbore 102 or at the surface 140.

A damper 110 can be implemented within the wellbore 102 to damp transmission of a pressure pulse through the fluid in the wellbore while allowing fluid flow through the wellbore during the pressure pulse. The damper 110 is a system of one or more techniques or components that can dissipate the energy waves 112 of the pressure pulse as they propagate through the fluids in the wellbore 102. The damper 110 can be positioned above and/or below the pressure pulse generator 120, for example, to damp transmission of the pressure pulse toward the surface 140 (when above) or deeper into the wellbore 102 (when below). The damper 110 provides an additional degree of damping beyond what is normally present in the wellbore environment. The damper 110 can be configured to provide a specified degree of damping. In some instances, the pressure pulse is of a magnitude that would, if undamped, cause damage to equipment in the wellbore 102, at the surface 140 or otherwise associated with the well 100. The degree of damping can be specified to prevent damage of any equipment associated with the well 100 due to the pressure pulse generated by the generator 120. The damper 110 is configured to allow fluid flow through the wellbore between the surface 140 and a location adjacent the pressure pulse generator 120, and in some instances allow fluid flow past the damper 110, while the damper is damping the pressure pulse. In certain instances, the damper 110 can seal flow in one direction while allowing flow in the opposing direction. However, the damper 110 need not seal against flow (in one or both directions) while damping. As such, the damper 110 enables maintaining fluid flow and pressure within the wellbore 102 during a well treatment. Thus, in an instance where treatment fluid 108 is being supplied to a subterranean zone 122 while the pressure pulse is being propagated into the subterranean zone 122, flow of the treatment fluid can continue uninterrupted. In other words, the damper 110 can operate during a fracturing treatment, during an acid treatment, during a water flood, during a steam injection and/or during other types of treatment, without necessitating the treatment be paused during the pressure pulse. However, the concepts herein are equally applicable to instances where the flow of treatment fluid is paused. The damper 110 can reduce the possibility of wellbore and equipment damage from the energy waves 112 while still maintaining appreciable pressure or flow within the wellbore 102. The damper system 110 can be located in the string tubing 104 (or on wire) or in the annulus between the string 104 and the casing 106 or in both.

Figure 2:
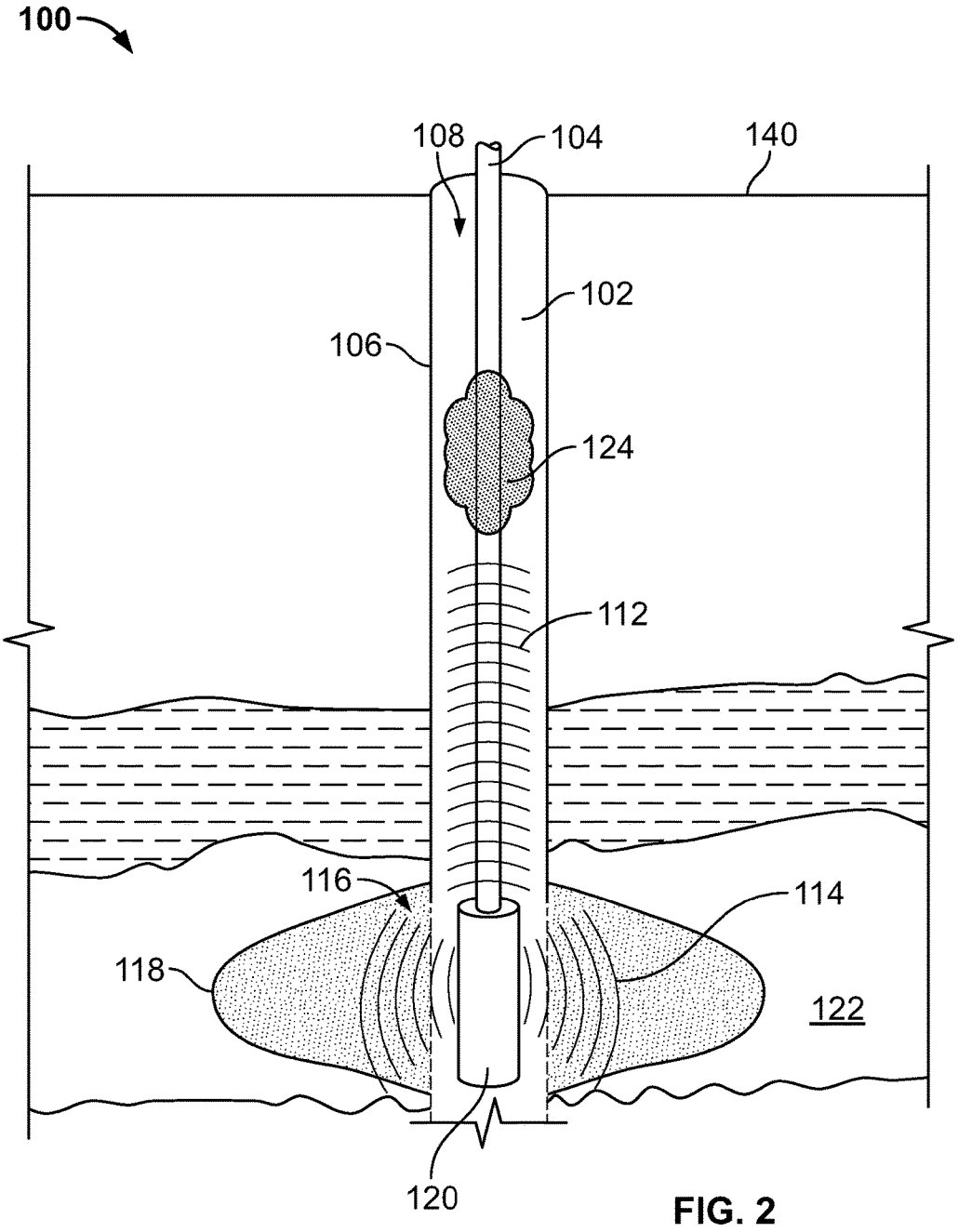
FIG. 2 is a schematic side cross-sectional view of an example well system with a gas slug as the damper system.
Figure 3:
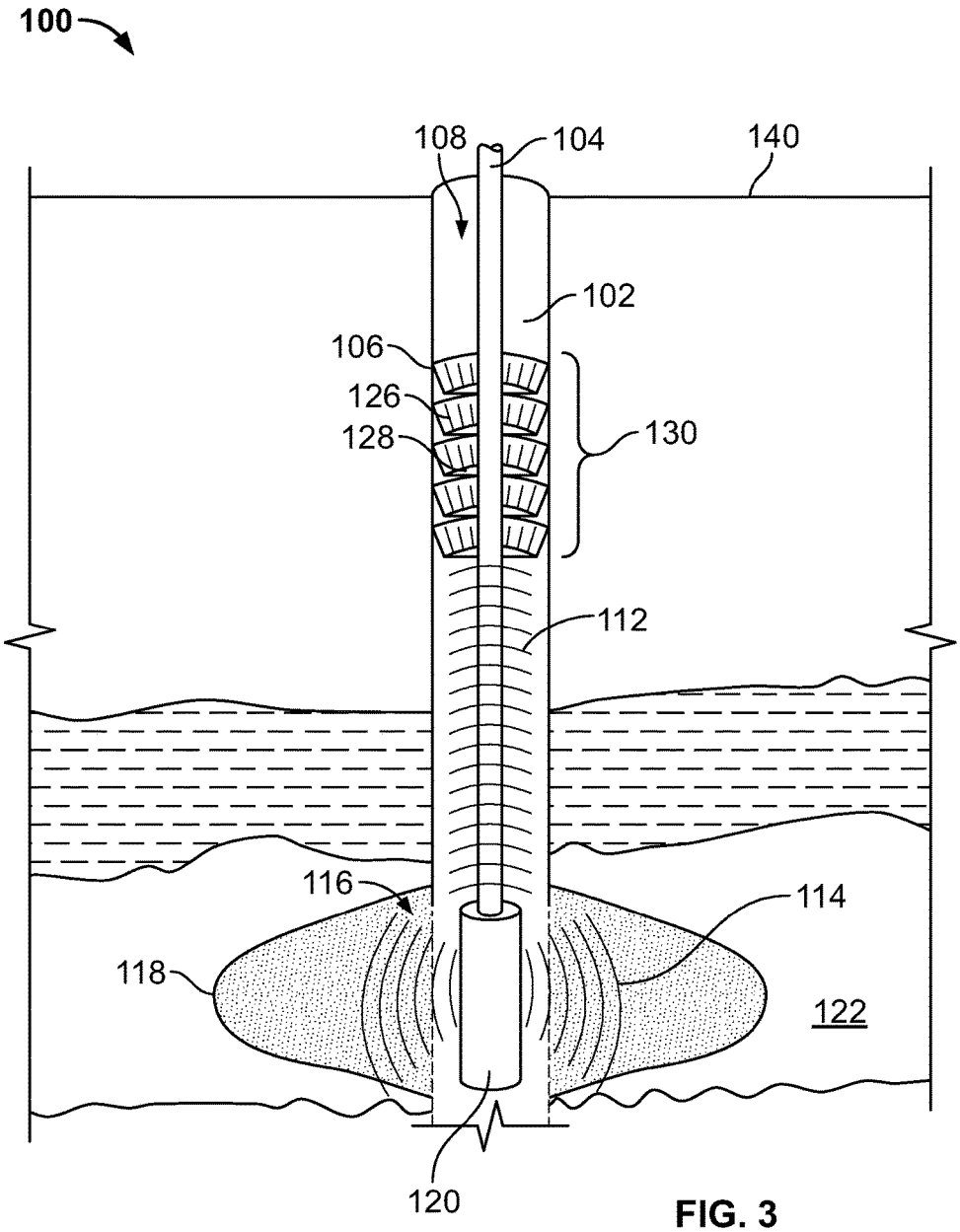
FIG. 3 is a schematic side cross-sectional view of an example well system with conical baffles as the damper system.
Figure 4:
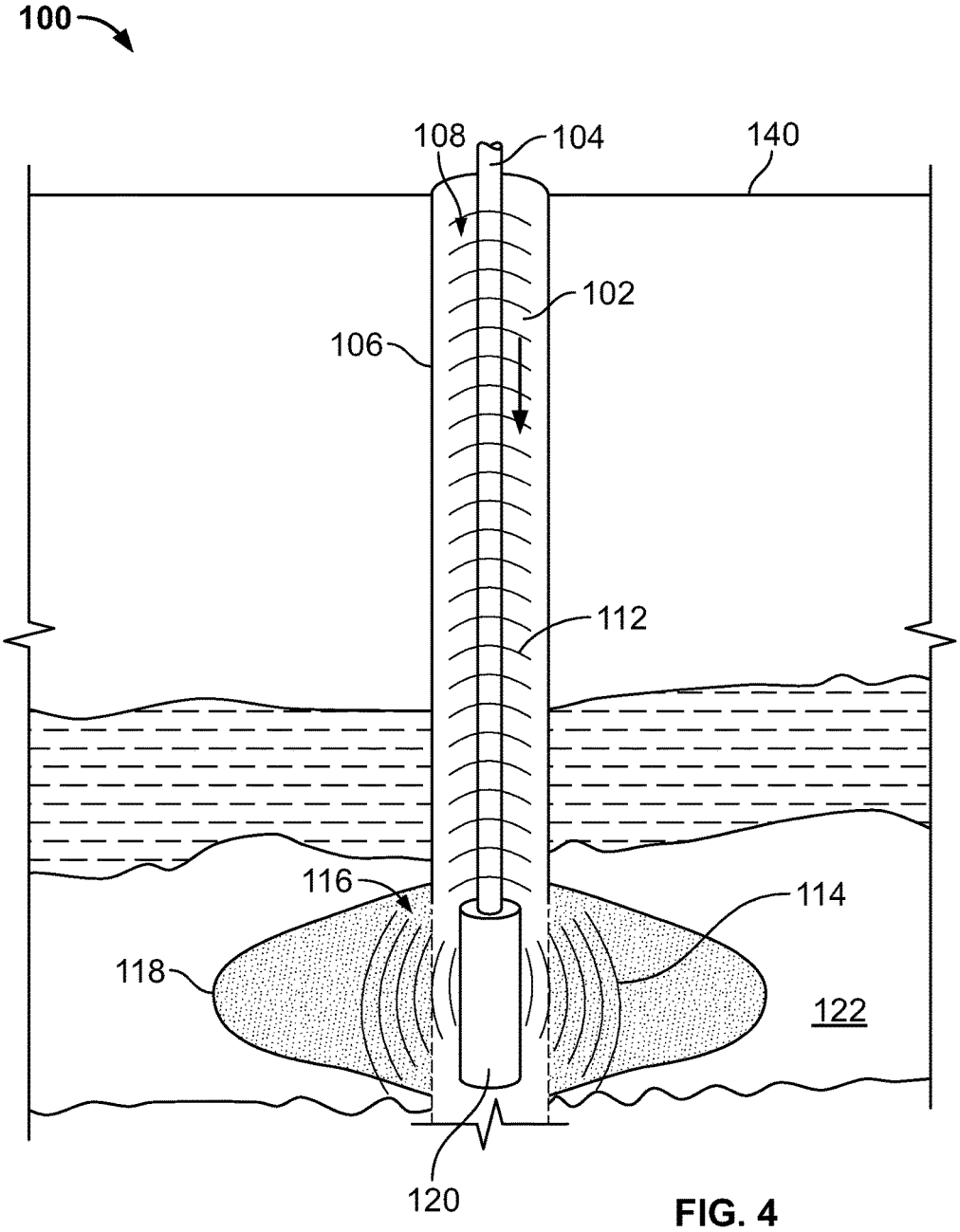
FIG. 4 is a schematic side cross-sectional view of an example well system with flow reduction as the damper system.

FIGS. 2, 3, and 4 show example techniques that can be used individually or in combination with each other for the damper system 110. FIG. 2 shows the well system 100 with a gas slug 124 used as the damper system. The gas slug 124 is a self-contained mass of gas or substantially gas that can displace some or all of another material around it. In certain instances, more than one gas slug 124, in tandem, may be used as the damper system. The gas slug 124 is a compressible medium, such as a fluid with low bulk modulus, a gas, or a foamed fluid. Due to its compressible nature, the gas slug 124 can absorb the energy waves 112. The characteristics such as volume, amount, and constituents of the of the gas slug 124 are selected to produce the specified degree of damping of the pressure pulse. In certain instances, the gas slug 124 can be injected with the treatment fluid 108 into the wellbore 102 and into the treatment fluids. The gas slug 124 can be carried by or travel with the treatment fluid 108 as it flows down the wellbore 102. The injection of the gas slug 124 can be timed such that the gas slug 124 is located at a specified position within the wellbore 102 when the pressure pulse generator 120 is activated. Alternately, or additionally, the gas slug 124 can be placed in the wellbore 102 using a circulating tool that provides an alternative flow path and ports at or near the specified position to flow the gas slug 124 into the well 100. The specified position can be selected to effectively contain the pressure pulse. For example, in certain instances, the gas slug 124 could be located just above the pressure pulse generator 120 when the pressure pulse generator 120 is activated. As another example, the gas slug 124 could be located at the upper boundary of the treatment zone 118 when the pressure pulse generator 120 is activated such that some or all of the effects from the pressure pulse are limited to the treatment zone 118. The closer the gas slug 124 is located to the pressure pulse generator 120, the more length of the wellbore 102 is potentially protected from possible damage.

FIG. 3 shows the well system 100 with example conical baffles 130 used as the damper system. The conical baffles 130 are approximately cone-shaped (such as a cone with a round base, a pyramidal shape, a portion of a conical or pyramidal shape, or some other generally tapered shape) components positioned inside the wellbore 102 and extend generally radially across the annulus. The conical baffles 130 include one or more conical components located within the wellbore. The conical baffles 130 can be attached to the wellbore casing 106 or to the working string 104 and/or to another component (e.g., tool) within the wellbore 102. The conical baffles 130 can all be attached to the same structure (e.g., all attached to the casing 106, to the working string 104, or to another component) or they can be distributed among two or more components. The example conical baffles in FIG. 3 are attached to the wellbore casing 106. In another embodiment, some number of conical baffles 130 could be attached to the string 104 while some number of separate conical baffles 130 are attached to the wellbore casing 106. The conical baffles 130 could include multiple baffles with different shapes positioned at different locations along the wellbore 102.

The sloped shape of the conical baffles 130 can be oriented to deflect and dissipate the energy waves 112 created by the pressure pulse generator 120 while still allowing treatment fluid 108 to flow downhole and maintain pressure within the wellbore 102. For example, when provided on the casing 106, the baffles 130 have their larger diameter oriented uphole and their smaller diameter oriented downhole. When provided on the working string 104, the baffles 130 have their larger diameter oriented downhole and their smaller diameter oriented uphole. The conical baffles 130 can have apertures, slots, valves or other openings that permit fluid flow in the downhole direction. In certain instances, the valves can be check valves oriented to permit fluid flow in the downhole direction and block fluid flow (and the energy waves) in the uphole direction. In certain instances, the conical baffles 130 can include a conical rigid main body 126 and a flexible lip 128 that flexes to permit fluid flow past the lip 128 in the downhole direction. The rigid body 126 could be composed of a rigid material such as steel or some other material or combination of materials. The rigid body 126 may be solid or may have apertures or slots. The flexible lip 128 is located around a perimeter of the rigid body 126 and can form a flexible seal contacting the working string 104, the wellbore casing 106, or another component of the well system. For example, in FIG. 3 the rigid body 126 is attached to the wellbore casing 106 and the flexible lip 128 is attached to the rigid body 126 and surrounds the string 104. The example flexible lip 128 forms a seal around the string 104 that allows fluid to flow downhole but partially or completely blocks pressure or fluid flowing upward toward the surface. In another example, the rigid body 126 could be attached to the string 104 and the flexible lip 128 could form a seal between the rigid body 126 and the wellbore casing 106. In another embodiment, the conical baffles 130 could be activated to expand or contract to regulate flow. The characteristics, such as configuration, materials and number of the baffles 130 can be selected to produce the specified degree of damping of the pressure pulse.

FIG. 4 shows the well system 100 with a flow reduction used as the damper system. Because the pressure of the pressure pulse and the pressure in the wellbore 102 is additive, to reduce the total pressure on the wellbore 102 during a pressure pulse, the flow of pumped treatment fluid 108 can be reduced such that the combined pressure of the reduced flow and the energy waves 112 is less than a specified pressure, e.g., a maximum safe pressure, and in effect provide the specified degree of damping. The flow reduction can be timed relative to the pressure pulse and have a duration such that the combined pressure is lessened. The fluid flow into the wellbore 102 can be reduced by decreasing the pumping rate and/or otherwise constricting the flow of fluid into the wellbore 102.

Figure 5:
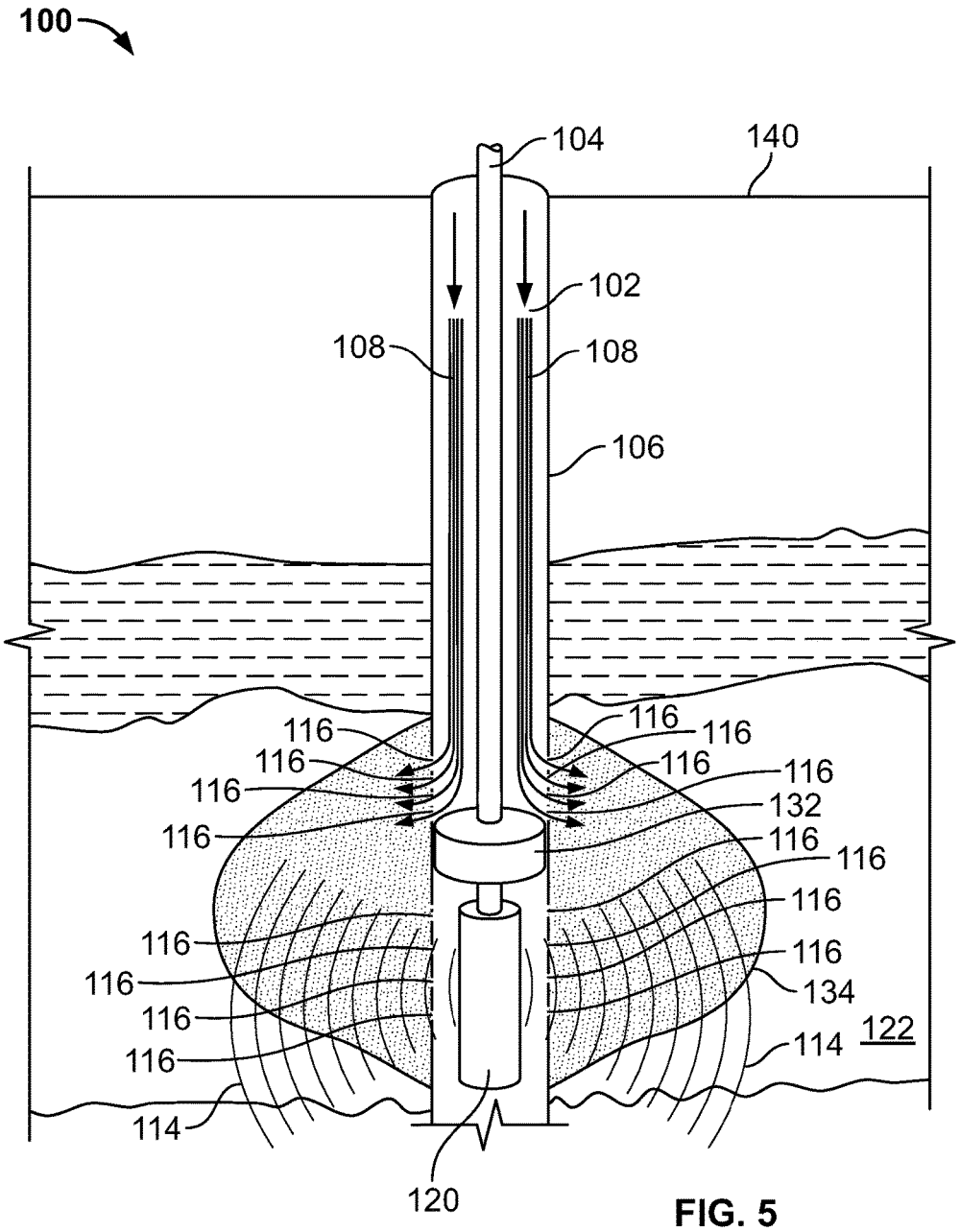
FIG. 5 is a schematic side cross-sectional view of an example well system that uses the formation in damping pressure pulses.

FIG. 5 shows the well system 100 where the formaiton is used in damping the pressure pulses 114. Particularly, two or more axially spaced apart sets of perforations 116 are formed in the casing 106, both within the subterranean zone 122 being treated. A fracture treatment is then performed on subterranean zone 122 to form a fracture or set of fractures 134 that span and/or otherwise fluidically communicate between the sets of spaced apart perforations 116. The pressure pulse generator 120 is run into the wellbore 102 in a string 104 with a packer 132 positioned above the generator 120. The packer 132 is set in the wellbore 102 between the sets of perforations 116, isolating an uphole set of the perforations 116 from a downhole set of the perforations 116. Thereafter, treatment fluid 108 can be pumped into the subterranean zone 122 from the surface 140 through the uphole set of perforations 116 and the pressure pulses 114 introduced into the subterranean zone 122 through the downhole set of perforations 116. The packer 132 seals (entirely or substantially) the annulus (i.e., seals against flow through the wellbore 102) and damps transmission of the pressure pulse 114 through the wellbore 102 toward the surface 140. Notably, the packer 132 need not seal entirely to damp transmission of the pressure pulse 114, and can allow some flow and communication of pressure through the wellbore 102. While the wellbore 102 uphole and downhole of the packer 132 is open to and in fluid communication, via the perforations 116 and fractures 134, the subterranean zone 122 damps transmission of the pressure pulses.

The above damping systems (gas slug, conical baffles, flow reduction, damping with the formation) can be used individually or in combination. All three example damping systems could be used on a single well system, or a subset could be used. For example, a gas slug could be injected into a wellbore in which conical baffles are installed. Additionally, flow reduction could be implemented along with a gas slug, or flow reduction could be implemented in a wellbore in which conical baffles are installed. Combining damping systems can be more effective in reducing unwanted pressure than using a single damping system.

A number of implementations have been described. Nevertheless, it will be understood that various modifications may be made. Accordingly, other implementations are within the scope of the following claims.

What is claimed is:

1. A well system, comprising:

a pressure pulse generator in a wellbore to generate a pressure pulse of specified characteristics through fluid in the wellbore;

a damper in the wellbore to damp transmission of the pressure pulse through the fluid while allowing fluid to flow between a terranean surface and a location adjacent the pressure pulse generator; and the damper comprises a gas slug in the fluid of characteristics to produce a specified degree of damping of the pressure pulse.

2. The well system of claim 1, where the gas slug comprises foam.

3. The well system of claim 1, where the damper comprises a generally radially protruding baffle in the fluid of characteristics to produce a specified degree of damping of the pressure pulse while allowing fluid to flow through the wellbore between the terranean surface and the location adjacent the pressure pulse generator.

4. The well system of claim 3, where the baffle is conical.

5. The well system of claim 3, where the baffle is carried by a working string residing in the wellbore, the working string comprising the pressure pulse generator.

6. The well system of claim 3, where the baffle is carried by a casing of the wellbore.

7. The well system of claim 3, where the baffle comprises a rigid main body and a flexible lip around a perimeter of the rigid main body.

8. The system of claim 1, where the pressure generated by the pressure pulse generator is approximately ten times greater than a pressure of the fluid in the wellbore.

9. The system of claim 1, where the fluid comprises at least one of a fracturing fluid, an acidizing fluid, or a water flood fluid.

10. The system of claim 1, wherein the damper is positioned above the pressure pulse generator.

11. A method, comprising:

receiving a damper into a wellbore;

damping transmission, through a fluid in the wellbore, of a pressure pulse generated by a pressure pulse generator in the wellbore while allowing fluid to flow between a terranean surface and a location adjacent the pressure pulse generator; and wherein receiving the damper into a wellbore comprises receiving a gas slug into the fluid, the gas slug of characteristics selected to produce a specified degree of damping of the pressure pulse.

12. The method of claim 11, where receiving the gas slug comprises receiving a gas slug comprising foam.

13. The method of claim 11, comprising receiving the gas slug into the fluid at the terranean surface at a time selected to communicate the gas slug to a location adjacent the pressure pulse generator when the pressure pulse generator emits the pressure pulse.

14. The method of claim 11 where receiving a damper into a wellbore comprises receiving a generally radially extending baffle in the fluid that is configured to produce a specified degree of damping of the pressure pulse.

15. The method of claim 14, where receiving a generally radially extending baffle in the fluid comprises at least one of receiving the baffle carried by a working string comprising the pressure pulse generator or receiving the baffle carried by a casing of the wellbore.

16. The method of claim 14, comprising allowing flow of the fluid past the baffle while generating the pressure pulse.

17. The method of claim 11, wherein the pressure pulse generated by the pressure pulse generator is approximately ten times greater than a pressure of the fluid in the wellbore.

18. A method, comprising:

receiving a damper into a wellbore, the damper including a gas slug;

damping transmission, through a fluid in the wellbore, of a pressure pulse generated by a pressure pulse generator in the wellbore while allowing fluid to flow between a terranean surface and a location adjacent the pressure pulse generator;

fracturing a subterranean zone about the wellbore to communicate between two axially spaced apart locations; and sealing the wellbore between the axially spaced apart locations.

* * * * *